United States Patent [19]

Gutner

[11] 4,003,539

[45] Jan. 18, 1977

[54] WALL HANGING DEVICE

[76] Inventor: Kenneth H. Gutner, 3285 Dato, Highland Park, Ill. 60035

[22] Filed: Jan. 26, 1976

[21] Appl. No.: 652,503

[52] U.S. Cl. ..... 248/489; 29/439; 29/509; 403/208

[51] Int. Cl.[2] ..... F16M 13/00

[58] Field of Search ..... 248/300, 301, 359, 360, 248/376, 377, 489, 492, 493, 494; 403/208; 29/439, 509; 24/265 AL

[56] References Cited

UNITED STATES PATENTS

| | | | |
|---|---|---|---|
| 698,068 | 4/1902 | Snell | 24/265 AL |
| 1,187,787 | 6/1916 | Seubert | 248/489 |
| 1,672,505 | 6/1928 | Stocker | 24/265 AL |
| 3,259,086 | 7/1966 | Stein | 248/360 X |
| 3,516,637 | 6/1970 | Lawson | 248/477 |

FOREIGN PATENTS OR APPLICATIONS

| | | | |
|---|---|---|---|
| 408,532 | 5/1924 | Germany | 248/489 |
| 496,407 | 11/1938 | United Kingdom | 248/489 |

*Primary Examiner*—William H. Schultz
*Attorney, Agent, or Firm*—Tilton, Fallon, Lungmus, Chestnut & Hill

[57] ABSTRACT

A wall hanging device having a ring-like member for connection to picture wire or the like and a relatively flat, elongated member having a looped end capturing the ring-like member.

4 Claims, 7 Drawing Figures

WALL HANGING DEVICE

BACKGROUND AND SUMMARY OF INVENTION

The invention relates to a device for hanging essentially flat objects, such as pictures, from a wall. For example, one or more of such devices could be affixed to the back of a framed picture, mirror, or the like, and then a wire attached to the device or devices so that the picture may be hung from a hook which has been affixed to the wall. In the alternative, the device may be hung directly on the wall.

In the prior art, the most common method of affixing the wire for hanging to the back of the framed picture was by the use of eyelets with threaded ends which screwed into the back of the picture frame. In addition, some looped straps with attached rings have been used, but these have been unreliable — failure of any part can cause damage or loss of a valuable picture, mirror, etc.

The drawbacks of the prior art are avoided by the instant invention wherein a ring-like part is captured within the looped end of a flat, elongated part secured to the flat surface of support. The looped end capturing the ring is defined in part by laterally extending integral tabs which clinchingly engage the elongated part and also a portion of the looped end itself to provide a superior joint.

Other advantages and objects of the invention may be seen in the ensuing specification in which a preferred embodiment of the invention is explained in detail.

DETAILED DESCRIPTION

The invention is described in conjunction with the accompanying drawing, in which FIG. 1 is a perspective view of the rear side of a picture or mirror and showing the environment of the inventive devices;

Figure 1:
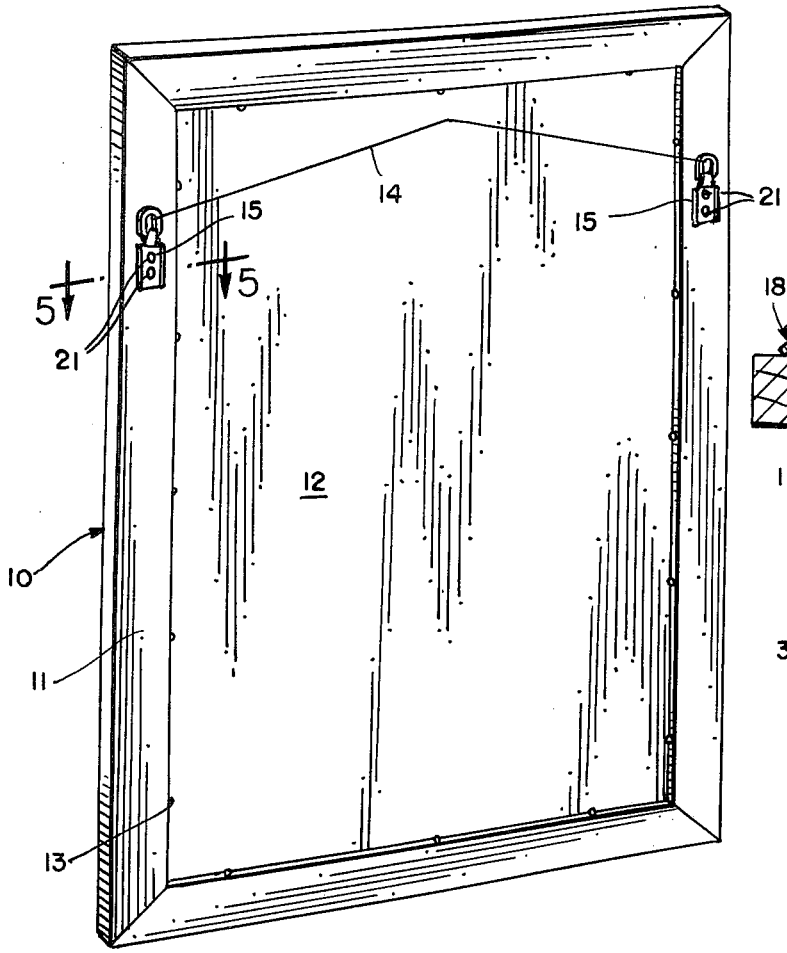

In the illustration given and with reference to FIG. 1, the numeral 10 generally designates a picture, mirror or the like when viewed from its reverse (i.e., wall-confronting) side. In the particular illustration given, the object 10 is a picture having a rectangular frame 11 (usually constructed of wood), a backing sheet or plate 12 removably maintained in place by clips or nails 13. The picture 10 is intended to be secured against a wall (not shown) by means of a wire 14 which is secured at either end to the inventive devices 15, or directly by one or more of the devices 15.

Figure 5:
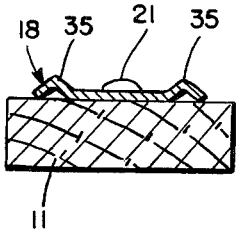
FIG. 5 is an enlarged fragmentary sectional view taken along the line 5—5 of FIG. 1.
Figure 2:
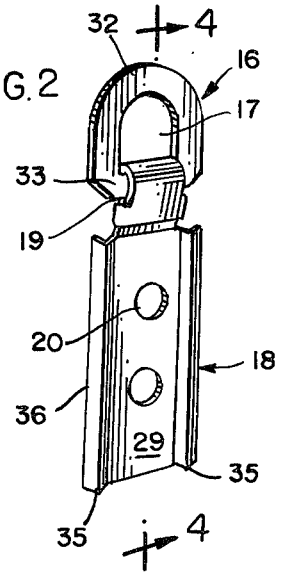
FIG. 2 is an enlarged perspective view of the device as it would be seen installed in FIG. 1.
Figure 3:
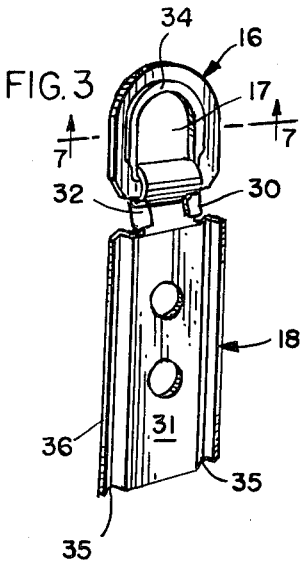
FIG. 3 is the reverse perspective view of the device, i.e., viewing the side of the device bearing against the picture frame in FIG. 1.
Figure 4:
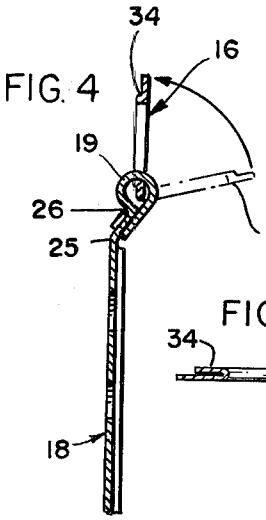
FIG. 4 is a vertical sectional view such as would be seen along the sight line 4—4 and showing the rotating feature of the ring part.
Figure 7:
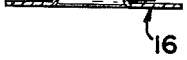
FIG. 7 is a sectional view taken along the line 7—7 of FIG. 3.

Reference is now made to FIG. 2 which is an enlarged perspective view of each device 15 as it is viewed in FIG. 1, i.e., the face presented to the viewer in FIG. 2 is the face remote from the frame 11. In contrast, the face presented to the viewer in FIG. 3 is that which confronts the frame 11. The device 15 includes a first part generally designated 16 which is essentially ring-like, having an annular shape defining a central aperture 17. The device 15 also includes a second part generally designated 18 which is generally elongated and also generally flat having at its upper end a looped part 19. Additionally, the second part or elongted member 18 may have one or more openings 20 extending therethrough for th receipt of screws, nails, rivets, etc. as are indicated by the numeral 21 in FIGS. 1 and 5.

Figure 6:
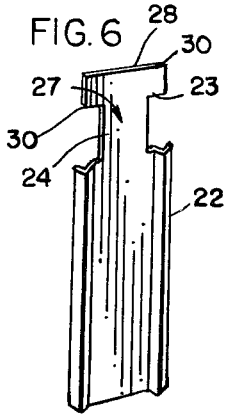
FIG. 6 is a perspective view of a blank from which the elongated second part is made.

The looped end 19 can be best appreciated through an understanding of its development, and this from a consideration of FIGS. 2–4 and 6. In FIG. 6, the blank for making the second part 18 is seen in its "unfloded" condition. The blank in FIG. 6 designated 22 is seen to have a body portion surmounted by an integral generally T-shaped portion 23. The neck 24 (still referring to FIG. 6) of the the generally T-shaped portion 23 is bent first on an angle of about 20°–40° — see FIG. 4 at 25. Thereafter, it is bent along a second line 26 spaced upwardly from the bend or fold line 25, and at an angle of about 90°. Further, the neck portion 24 is on a discrete radius of curvature in the direction of the arrow 27, thus bringing the T-bar portion 28 into overlying relation with the face 29 (see FIG. 2) of the second part 18. Thereafter, the end or integral tab portions 30 (see FIGS. 3 and 6) are clinched or folded on themselves to bear against the face 31 of the second part 18.

Additionally, it will be noted that portions of the tabs 30 as at 32 bear against the looped portion 19 (see FIG. 3) which provides an advantageous stabilization. More particularly, the act of crimping the tabs 30 into the FIG. 3 position causes a slight deformation in the looped end 19 which tends to anchor the tabs 30 firmly in place — particularly against any force tending to unfold or open up the looped end 19. In addition, In addition, because the tabs 30 abut the looped end 19, there is no opportunity for the tabs 30 to slide along the second member 18 and thus inadvertently open the loop.

The first member 16 has generally the shape of an annulus flattened along its lower side (see particularly FIGS. 2 and 3). The annulus in this flattened area (as at 33 in FIG. 2) permits pivoting of the first member 16 in the fashion indicated in FIG. 4 — to the position designated 16'. Further, the annulus or ring-like first member 16 is equipped with a reversely folded flange 34 (see FIG. 3) which overlies the mirror-confronting face of the first member 16 and provides a more gently rounded radius defining the aperture 17 so as to avoid any sharp edge biting into the wire 15.

The second member 18 is equipped with a pair of longitudinally extending ribs 35 (see particularly FIG. 5) which outstand from the face 27. These ribs 35 are adjacent to the respective longitudinal sides 36 (see FIGS. 2 and 3) of the second member 18 and provide an advantageous stiffening function. For example, if one of the securing means 21, i.e., wood screws, happens to become loose or fall out of its mounting within the frame 11, any tendency of the second member 18 to buckle transversely is advantageously resisted by the ribs 35. Further, the ribs 35 resist any transverse or angular cracking which might be occasioned by an improperly directed rivet should the same be used in place of the wood screws 21. In the commercial application of the inventive devices to a picture frame 11, rivet guns may be employed and if improperly directed may impinge upon the portions of the second member 18 around the openings 20. By virtue of employing the stiffening ribs 35, any tendency of the rivet fired from the gun to shatter the second member 18 is advantageously opposed.

As a specific example of the invention, the parts 16 and 18 are made of 24-gauge sheet steel and the overall length is about 2 inches. The radius of the aperture 17 is approximately ½ inch and the overall width of the ring-like first member is about ¾ inch. By the offset developed by folding along the bend lines 25 and 26, the looped end 19 is spaced from the rear of the frame 11 to afford convenient access to the aperture 17. These bends (as at 25 and 26) are further stabilized and rigidified by the clinching engagement of the T-bar part 28.

I claim:

1. A device for hanging objects from a wall comprising a centrally-apertured, generally flat first part and a relatively elongated, flat second part, said second part having one end folded on itself about a discrete radius of curvature to provide a looped end portion, said first part being mounted within said looped end, said looped end portion being equipped with integral, laterally extending integral tabs folded on themselves and clinchingly embracing said second part to frictionally contact said second part immediately adjacent said looped end portion to stabilize said looped end portion against opening, said second part having at least one opening to accept means to secure said second member to a flat surface.

2. The device of claim 1 in which said first part has an integral reversely folded annular flange to provide a reinforced thickness about said aperture, said flange being narrower than the remainder of said first part.

3. The device of claim 1 in which said looped end portion is disposed at an acute angle to the remainder of said second part to offset said looped end portion and first part from the surface of an object to which said device is secured.

4. The device of claim 1 in which said second part is equipped with a narrowed portion adjacent one end to provide said looped end portion, said second part being equipped with a longitudinally extending rib adjacent to each longitudinal side of said second part extending from the other end thereof to said narrowed portion.

* * * * *